US010472993B2

(12) United States Patent
Magee et al.

(10) Patent No.: US 10,472,993 B2
(45) Date of Patent: Nov. 12, 2019

(54) OUTPUT MANIFOLD FOR HEAT RECOVERY STEAM GENERATIONS

(71) Applicant: General Electric Company, Schenectady, NY (US)

(72) Inventors: Jeffrey Frederick Magee, Longmeadow, MA (US); Van Dang, Bloomfield, CT (US)

(73) Assignee: General Electric Company, Schenectady, NY (US)

( * ) Notice: Subject to any disclaimer, the term of this patent is extended or adjusted under 35 U.S.C. 154(b) by 154 days.

(21) Appl. No.: 15/830,525

(22) Filed: Dec. 4, 2017

(65) Prior Publication Data

US 2019/0170019 A1 Jun. 6, 2019

(51) Int. Cl.

| | |
|---|---|
| ***F01K 11/02*** | (2006.01) |
| ***F28F 9/02*** | (2006.01) |
| ***F01K 7/38*** | (2006.01) |
| ***F01K 23/10*** | (2006.01) |

(52) U.S. Cl.

CPC ..... *F01K 11/02* (2013.01); *F01K 7/38* (2013.01); *F01K 23/101* (2013.01); *F28F 9/0246* (2013.01)

(58) Field of Classification Search

CPC ..... F01K 11/02; F01K 7/38; F01K 23/101; F28F 9/0246

See application file for complete search history.

(56) References Cited

U.S. PATENT DOCUMENTS 3,101,930 A * 8/1963 Huet ..... F28D 7/10 165/143
3,835,920 A * 9/1974 Mondt ..... F28D 7/06 165/81
3,866,674 A * 2/1975 Tramuta ..... F28D 9/0031 165/166
4,196,700 A * 4/1980 Keseru ..... F24H 1/406 122/235.14
4,254,826 A * 3/1981 Adams ..... F28D 7/106 165/143
6,957,630 B1 * 10/2005 Mastronarde ..... F22B 1/1815 122/406.4
7,963,097 B2 * 6/2011 Mastronarde ..... F28D 7/1623 60/39.511
2007/0101717 A1 * 5/2007 Beaulieu ..... F01K 13/00 60/645
2010/0122793 A1 * 5/2010 Wolfe, IV ..... B60H 1/00321 165/58
2011/0239696 A1 * 10/2011 Takagi ..... B60H 1/00335 62/524
2013/0086938 A1 * 4/2013 Higashiyama ..... B65D 7/42 62/524
2017/0211894 A1 * 7/2017 Schwalm ..... F28F 9/02
2018/0163573 A1 * 6/2018 Dang ..... F01K 23/10

* cited by examiner

*Primary Examiner* — Mark A Laurenzi
*Assistant Examiner* — Shafiq Mian
(74) *Attorney, Agent, or Firm* — Dale Davis; Hoffman Warnick LLC

(57) ABSTRACT

This disclosure provides manifolds, manifold components, and heat recover steam generator systems. An output line of an output manifold is fluidically connected to at least one downstream process. A first collection line is fluidically connected to a plurality of header lines by a first set of header links. A second collection line is fluidically connected to the plurality of header lines by a second set of header links. A connecting junction fluidically connects the first collection line and the second collection line to the output line.

17 Claims, 3 Drawing Sheets

OUTPUT MANIFOLD FOR HEAT RECOVERY STEAM GENERATIONS

BACKGROUND OF THE INVENTION

The disclosure relates to heat recovery steam generators and, more specifically, output manifolds for high cycling heat recovery steam generator systems.

Heat recovery steam generator systems may include an output manifold for aggregating flow and routing the working fluid to a steam turbine and/or other process demand. An HRSG may be fluidically connected to a plurality of header lines for directing fluid flow of low pressure, high pressure, and superheated steam through the stages of the HRSG. The output manifold contains and directs the flow of high temperature, pressurized fluids, such as superheated steam from the superheated steam lines among the header lines. Any given output manifold may have defined flow capacities, wall thickness, materials, and link assemblies for controlling and enduring thermal stresses. However, thermal stress from high cycling systems may increase component wear and decrease the life of the output manifold and/or its components.

Some output manifolds include a single output line receiving fluids directly from a plurality of header links that are connected to a plurality of header lines carrying heated fluids. The single output line is sized for the output capacity of the system and the needs of the downstream steam turbine or other process demand. The diameter, thickness, and material requirements of the single output line may increase both initial and replacement costs of the output manifold and/or require that the entire manifold be replaced in the event of wear or a failure.

SUMMARY OF THE INVENTION

A first aspect of this disclosure provides a manifold for a heat recovery steam generator system. An output line defining an output path is fluidically connected to at least one downstream process component. A first collection line is fluidically connected to a plurality of header lines by a first set of header links. A second collection line is fluidically connected to the plurality of header lines by a second set of header links. A connecting junction fluidically connects the first collection line and the second collection line to the output line.

A second aspect of the disclosure provides a heat recovery steam generator system with a manifold. A heat recovery steam generator generates heated fluids. A plurality of header lines are configured to receive heated fluids from the heat recovery steam generator. An output manifold is configured to provide heated fluids to at least one downstream process component. The output manifold includes an output line, a first collection line, a second collection line, and a connecting junction. The output line defines an output path fluidically connected to the at least one downstream process. The first collection line is fluidically connected to the plurality of header lines by a first set of header links. A second collection line is fluidically connected to the plurality of header lines by a second set of header links. A connecting junction fluidically connects the first collection line and the second collection line to the output line.

A third aspect of the disclosure provides a connecting tee member for an output manifold of a heat recovery steam generator system. A base portion of the connecting tee member defines a base fluid path and is configured to engage an output line of the output manifold. A first branch portion defines a first branch fluid path perpendicular to the base fluid path and is configured to engage a first collecting line. A second branch portion defines a second branch fluid path perpendicular to the base fluid path and is configured to engage a second collecting line. The first branch fluid path is diametrically opposed to the second branch fluid path around a base circumference of the base portion. The first branch portion has a first branch length equal to a first connecting line spacing between the first connecting line and the output line. The second branch portion has a second branch length equal to a second connecting line spacing between the second connecting line and the output line.

The illustrative aspects of the present disclosure are arranged to solve the problems herein described and/or other problems not discussed.

BRIEF DESCRIPTION OF THE DRAWINGS

These and other features of this disclosure will be more readily understood from the following detailed description of the various aspects of the disclosure taken in conjunction with the accompanying drawings that depict various embodiments of the disclosure, in which.

Figure 1:
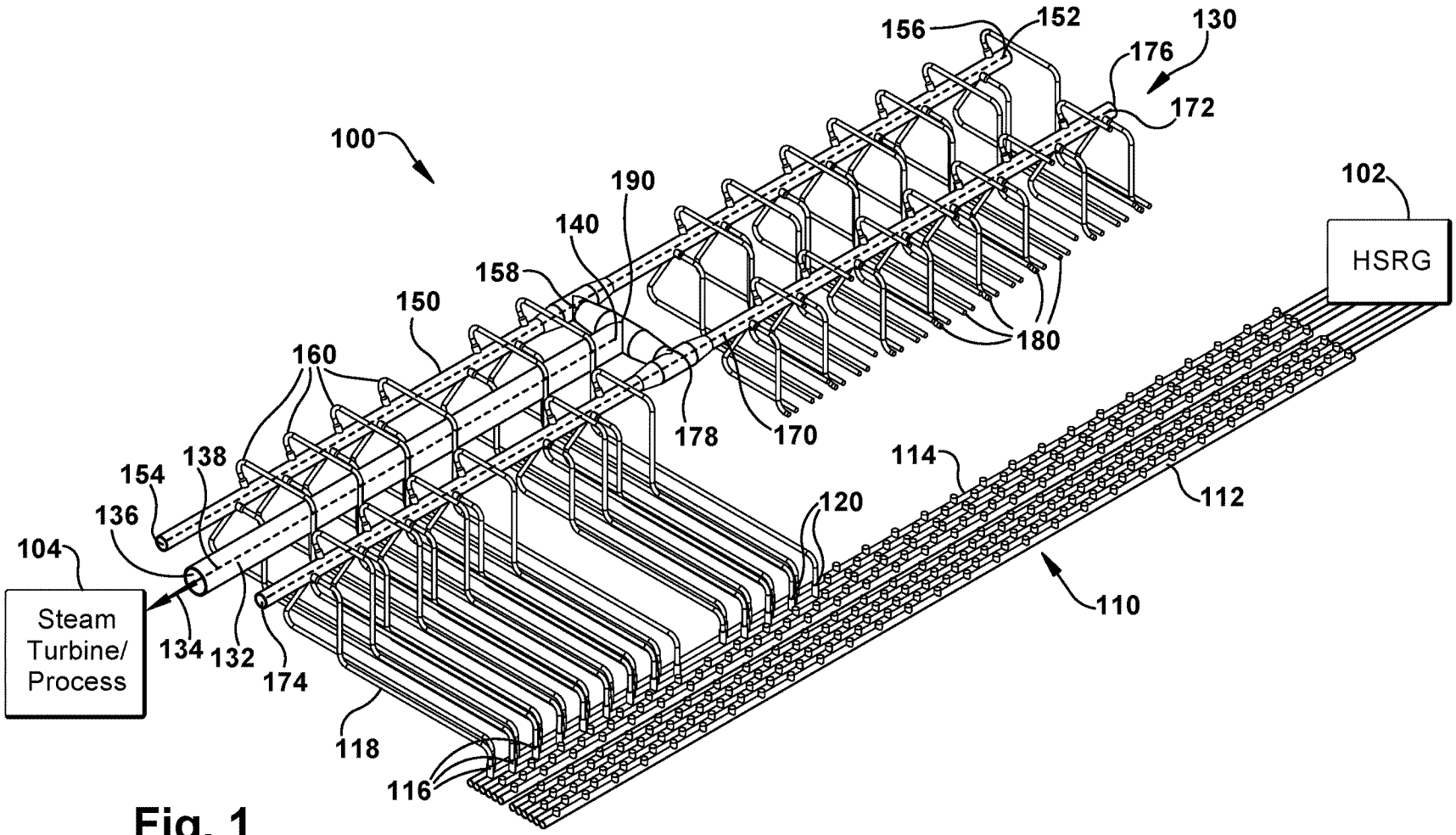
FIG. 1 shows a diagram of an example heat recovery steam generator system according to various embodiments of the disclosure.

It is noted that the drawings of the disclosure are not necessarily to scale. The drawings are intended to depict only typical aspects of the disclosure, and therefore should not be considered as limiting the scope of the disclosure. In the drawings, like numbering represents like elements between the drawings.

DETAILED DESCRIPTION OF THE INVENTION

In the following description, reference is made to the accompanying drawings that form a part thereof, and in which is shown by way of illustration specific illustrative embodiments in which the present teachings may be practiced. These embodiments are described in sufficient detail to enable those skilled in the art to practice the present teachings and it is to be understood that other embodiments may be used and that changes may be made without departing from the scope of the present teachings. The following description is, therefore, merely illustrative.

Where an element or layer is referred to as being "on," "engaged to," "disengaged from," "connected to" or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Referring to FIG. 1, an example heat recovery steam generator system 100 is depicted with a heat recovery steam generator (HRSG) 102, steam turbine/process component 104, header lines 110, and output manifold 130. HRSG 102 may include an energy recovery heat exchanger for extracting heat from a hot gas stream. In some embodiments, HRSG 102 produces heated fluids, such as high-pressure superheated steam, for use by steam turbine/process 104. Steam turbine/process component 104 may include a variety of downstream systems for using the heated fluids, such as powering a steam turbine or another steam-driven process. HRSG 102 may include vertical or horizontal, single pressure or multi-pressure, and/or other configurations to generate and direct heated fluids into header lines 110.

Header lines 110 may include a plurality of headers for directing fluid flow into HRSG 102 and/or receiving fluid flow out of HRSG 102. For example, header lines 110 may include a plurality of inlet header lines 112 and a plurality of outlet header lines 114. Header lines 110 may include any number of lines, including pipes or other fluid channels, arranged in parallel rows. For example, outlet header lines 114 may include seven individual header lines. Output header lines 114 may include a number of header line outlets 116 for attaching to header connecting lines 118. Header line outlets 116 may provide fluidically connectable outlets from output header lines 114 for directing fluids into output manifold 130. Header connecting lines 118 may attach to output header lines 114 and output manifold 130 to fluidically connect header lines 110 to output manifold 130. In some embodiments, header line outlets 116 may be grouped into sets based on where they are collecting fluids from and/or directing fluids too. For example, output manifold 130 may include inlets configured in sets of three and header line outlets 116 may also be grouped in sets of three to support the inlet configuration. In some embodiments, header line outlets 116 may include outlet fittings 120, such as a nozzle, pipe connector, or other component, for attaching header connecting lines 118 to header line outlets 116. Header connecting lines 118 may include various configurations of pipes or other fluid channels that extend from header lines 110 to output manifold 130 to fluidically connect them and traverse the distance between header lines 110 and output manifold 130, generally determined by the physical arrangement of heat recovery steam generator system 100 within a given site. Note that some header connecting lines have not been shown in FIG. 1 on the right side of output manifold 130 to improve visibility of other structures, but would be present in the example configuration shown.

Output manifold 130 may receive heated fluids from the plurality of header connecting lines 118 and consolidate the fluid flow into one or more combined fluid paths leading to steam turbine/process 104. Output manifold 130 may include an output line 132 defining an output path 134 fluidically connected to at least one downstream process, such as steam turbine/process 104. Fluids flowing into output line 132 may be directed out of output manifold 130 through manifold outlet 136, which may connect to further equipment or lines to fluidically connect with steam turbine/process 104. Output line 132 may have an output line length 138 measured from manifold outlet 136 to output line inlet 140.

Output manifold 130 may include one or more collecting lines 150, 170 fluidically connected to header lines 110 for receiving heated fluids from HRSG 102 and directing those heated fluids to output line 132. In some embodiments, output manifold 130 may include two collecting lines 150, 170 in a spaced parallel configuration whereby one collecting line 150 has collecting line length 152 and another collecting line 170 has collecting line length 172 and collecting line lengths 152, 172 are parallel to one another. Collecting lines 150, 170 may be separated from output line 132 by a defined distance and collecting line lengths 152, 172 may be parallel to output line length 138. Collecting line lengths 152, 172 may be measured from their respective distal ends 154, 156, 174, 176. In some embodiment, distal ends 154, 156, 174, 176 are sealed and do not provide an outlet for fluids within collecting lines 150, 170. For example, collecting line outlets 158, 178 may be positioned along collecting line lengths 152, 172 away from distal ends 154, 156, 174, 176. In some embodiments, collecting line outlets 158, 178 may be positioned at a midpoint of collecting line lengths 152, 172 and connect to a connecting tee member 190 that connects to output line 132. For example, output line length 138 may be approximately half of collecting line lengths 152 such that output line inlet 140 aligns and connects with connecting tee member 190 at approximately the midpoint of collecting line lengths 152, 172. In some embodiments, substantially all fluids through collecting lines 150, 170 exit through single collecting line outlets 158, 178 in each of collecting lines 150, 170 and into output line 132 through output line inlet 140.

Collecting lines 150, 170 may receive heated fluids from header lines 110 through the plurality of header connecting lines 118 connected to a corresponding plurality of header links 160, 180. In some embodiments, header links 160, 180 may be connected to the same header lines 110 through multiple outlet fittings 120 along the length of each of header lines 110. For example, header lines 110 may support 42 header connecting lines 118 and a first set of 21 of header connecting lines 118 may connect to header links 160 and collecting line 150 and a second and distinct set of 21 of header connecting lines 118 may connect to header links 180 and collecting line 170. The first set of connecting lines 118 for header links 160 and the second set of connecting lines 118 for header links 180 may be configured in a variety of groupings or patterns along the length of header lines 110, generally including alternating patterns of one or more of connecting lines 118 connecting to a corresponding number of header links 160 followed by one or more of connecting lines 118 connecting to a corresponding number of header links 180 and repeating the alternating connections along the length of header lines 110. In some embodiments, these alternating subsets of header connecting lines 118 may be three lines each.

Figure 2:
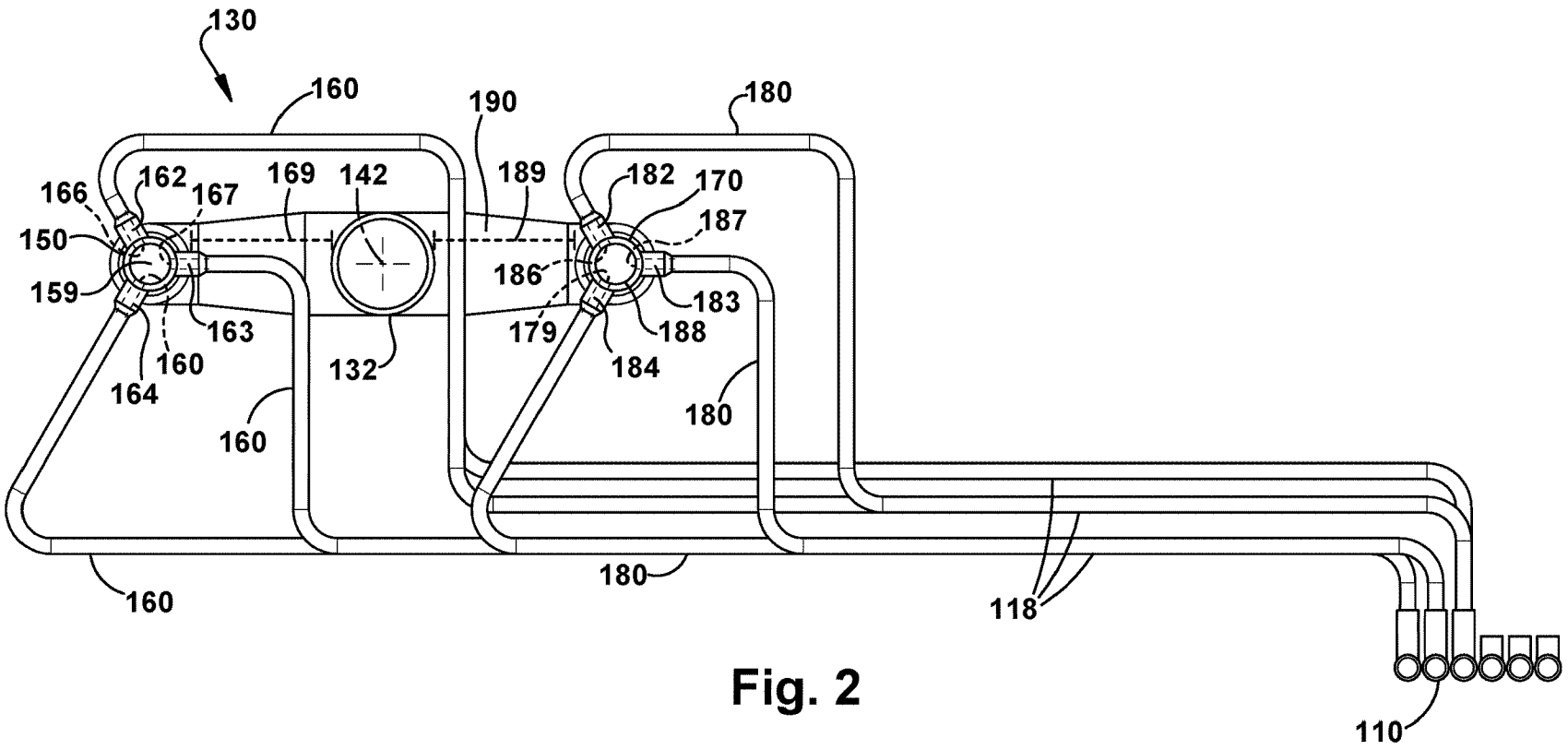
FIG. 2 shows an end cutaway view of an example output manifold according to various embodiments of the disclosure.

Referring to FIG. 2, an end cutaway view of output manifold 130 and connected header lines 110 and header connecting lines 118 are shown. In some embodiments, three header links 160, 180 may be spaced evenly around the circumference of collecting lines 150, 170. For example, a set of three of header links 160 may include header link nozzles 162, 163, 164 that have header link outlets 166, 167, 168 into collecting line 150 at even spacings around the circumference of collecting line 150. A set of three of header links 180 may include header link nozzles 182, 183, 184 that have header link outlets 186, 187, 188 into collecting line 170 at even spacings around the circumference of collecting line 170.

In some embodiments, the flow capacity of individual collecting lines 150, 170 may be less than the flow capacity of output line 132. For example, output diameter 142 of output line 132 may be larger than collecting line diameters 159, 179. In some embodiments, the output diameter 142 is at least twice the collecting line diameters 159, 179. In some embodiments, the ratio of the cross-sectional area of collecting line diameters 159, 179 to the cross-sectional area of the output diameter 142 may be in the range of 1:2 to 1:4.

In some embodiments, outlet line 132 and collecting lines 150, 170 may be parallel and aligned in a common plane such that a line can be drawn across outlet diameter 142 and collecting line diameters 159, 179. Collecting lines 150, 170 may be spaced laterally from outlet line 132 on diametrically opposed sides, such that outlet line 132 is between collecting lines 150, 170. Collecting lines 150, 170 may be separated by defined collecting line spacings 169, 189 from outlet line 132. In some embodiments, collecting line spacing 169 may be equal to collecting line spacing 189. In some embodiments, collecting line spacings 169, 189 may be defined and maintained by the configuration of connecting tee member 190, which fluidically connects collecting lines 150, 170 to outlet line 132.

Figure 3:
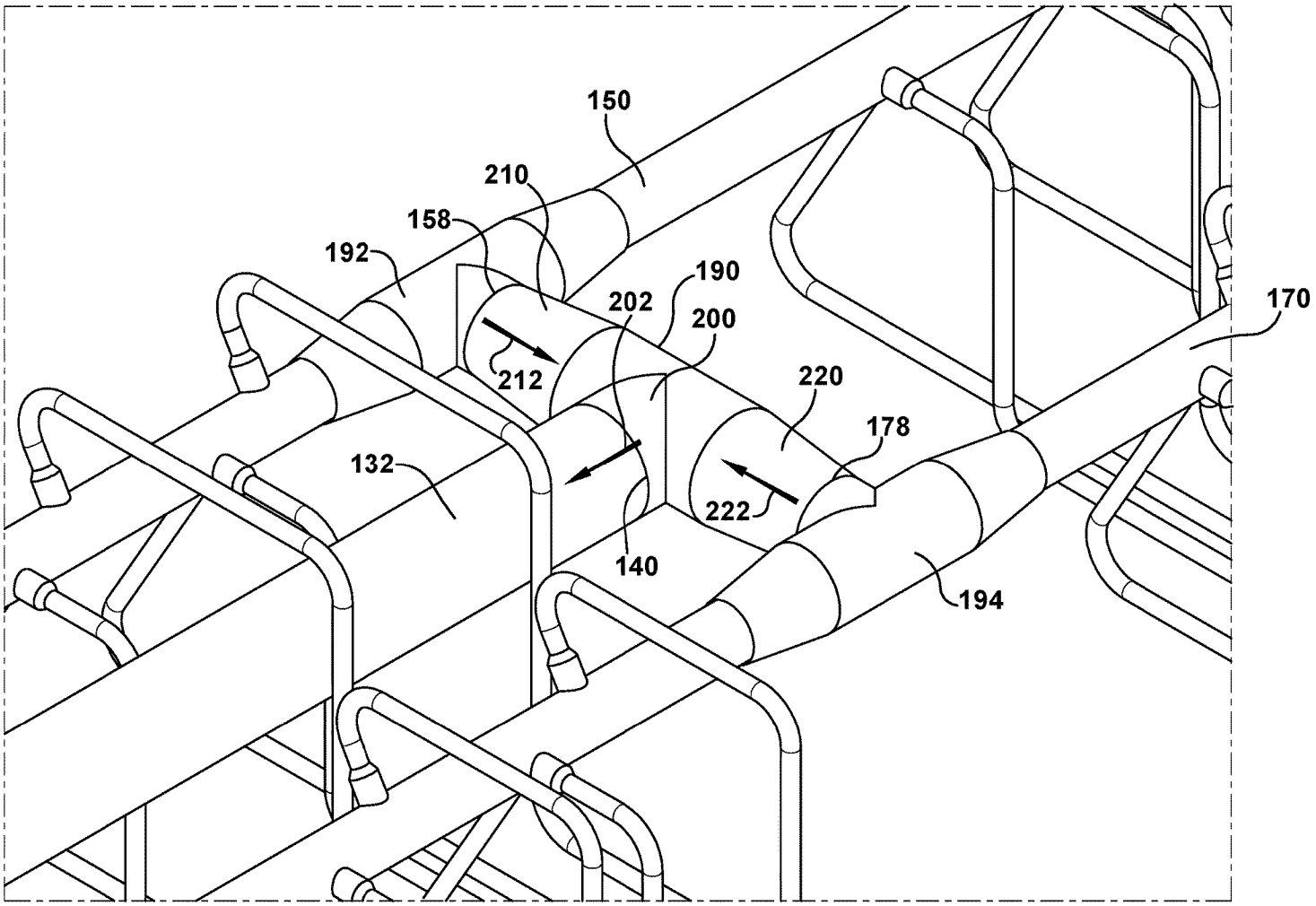
FIG. 3 shows a perspective view of an example connecting tee member according to various embodiments of the disclosure.

Referring to FIG. 3, connecting tee member 190 is shown interconnecting collecting lines 150, 170 to outlet line 132. In some embodiments, collecting lines 150, 170 may pass through or otherwise be attached to collecting line coupling members 192, 194 and collecting line coupling members 192, 194 may surround and/or define collecting line outlets 158, 178. For example, collecting line 150 may connect to connecting tee member 190 via collecting line coupling member 192 at collecting line outlet 158. Collecting line 170 may connect to connecting tee member 190 via collecting line coupling member 194 at collecting line outlet 178.

In some embodiments, connecting tee member 190 may include a base member 200 and branch members 210, 220. Base member 200 may connect to outlet line 132 at outlet line inlet 140 and define a base fluid path 202 into outlet line 132. Branch member 210 may connect to collecting line 150 at collecting line outlet 158 and define a branch fluid path 212 into base member 200. Branch member 220 may connect to collecting line 170 at collecting line outlet 178 and define a branch fluid path 222. In some embodiments, branch member 210 and branch fluid path 212 may be parallel and/or axially aligned with branch member 220 and branch fluid path 222 and may include opposing flow directions. In some embodiments, branch members 210, 220 and branch fluid paths 212, 222 may be perpendicular to base member 200 and base fluid path 202. In some embodiments, base member 200 and branch members 210, 220 may form a continuous component that is attached to outlet line 132 and collecting lines 150, 170 at their respective outlet line inlet 140 and collecting line outlets 158, 178.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application, and to enable others of ordinary skill in the art to understand the disclosure for various embodiments with various modifications as are suited to the particular use contemplated.

What is claimed is:

1. A manifold comprising:

an output line defining an output path fluidically connected to at least one downstream process component;

a first collection line fluidically connected to a plurality of header lines by a first set of header links;

a second collection line fluidically connected to the plurality of header lines by a second set of header links;

a connecting junction fluidically connecting the first collection line and the second collection line to the output line; and wherein the connecting junction includes a connecting tee member defining a base fluid path, a first branch fluid path perpendicular to the base fluid path, and a second branch fluid path perpendicular to the base fluid path, wherein the base fluid path is connected to an input end of the output line, the first branch fluid path is connected to the first collection line, and the second branch fluid path is connected to the second collection line.

2. The manifold of claim 1, wherein the first branch fluid path is diametrically opposed to the second branch fluid path around a base circumference of the connecting tee member.

3. The manifold of claim 1, wherein the first collection line has: a first collection line length from a first collection line first end to a first collection line second end, and a first collection line midpoint equidistant from the first collection line first end and the first collection line second end; the second collection line has: a second collection line length from a second collection line first end to a second collection line second end, and a second collection line midpoint equidistant from the second collection line first end and the second collection line second end; the first branch fluid path is connected to the first collection line at the first collection line midpoint; and the second branch fluid path is connected to the second collection line at the second collection line midpoint.

4. The manifold of claim 1, wherein the first collection line is parallel to the second collection line.

5. The manifold of claim 1, wherein the first collection line is separated from the output line by a first collection line spacing, the second collection line is separated from the output line by a second collection line spacing, the connecting junction spans the first collection line spacing and the second collection line spacing, and the first collection line spacing is equal to the second collection line spacing.

6. The manifold of claim 1, wherein the output line is parallel to the first collection line and the second collection line, the output line has an output line length, the first collection line has a first collection line length, the second collection line has a second collection line length, and the output line length is less than then first collection line length and less than the second collection line length.

7. The manifold of claim 1, wherein the plurality of header lines include sequential sets of connecting lines, alternating sets of the sequential sets of connecting lines defined as odd alternating sets or even alternating sets, the odd alternating sets connecting to the first set of header links and the even alternating sets connecting to the second set of header links.

8. The manifold of claim 1, wherein the output line has an output line diameter, the first collecting line has a first collecting line diameter, the second collecting line has a second collecting line diameter, and the output line diameter is at least twice the first collecting line diameter and at least twice the second collecting line diameter.

9. The manifold of claim 1, wherein the manifold comprises a portion of a heat recovery steam generator system.

10. A heat recovery steam generator system comprising:

a heat recovery steam generator that generates heated fluids;

a plurality of header lines configured to receive the heated fluids from the heat recovery steam generator; and, an output manifold configured to provide the heated fluids to at least one downstream process component and comprising:

an output line defining an output path fluidically connected to the at least one downstream process;

a first collection line fluidically connected to the plurality of header lines by a first set of header links;

a second collection line fluidically connected to the plurality of header lines by a second set of header links;

a connecting junction fluidically connecting the first collection line and the second collection line to the output line; and wherein the connecting junction includes a connecting tee member defining a base fluid path, a first branch fluid path perpendicular to the base fluid path, and a second branch fluid path perpendicular to the base fluid path, wherein the base fluid path is connected to an input end of the output line, the first branch fluid path is connected to the first collection line, and the second branch fluid path is connected to the second collection line.

11. The heat recovery steam generator system of claim 10, wherein the first branch fluid path is diametrically opposed to the second branch fluid path around a base circumference of the connecting tee member.

12. The heat recovery steam generator system of claim 10, wherein the first collection line has: a first collection line length from a first collection line first end to a first collection line second end, and a first collection line midpoint equidistant from the first collection line first end and the first collection line second end; the second collection line has: a second collection line length from a second collection line first end to a second collection line second end, and a second collection line midpoint equidistant from the second collection line first end and the second collection line second end; the first branch fluid path is connected to the first collection line at the first collection line midpoint; and the second branch fluid path is connected to the second collection line at the second collection line midpoint.

13. The heat recovery steam generator system of claim 10, wherein the first collection line is parallel to the second collection line.

14. The heat recovery steam generator system of claim 10, wherein the first collection line is separated from the output line by a first collection line spacing, the second collection line is separated from the output line by a second collection line spacing, the connecting junction spans the first collection line spacing and the second collection line spacing, and the first collection line spacing is equal to the second collection line spacing.

15. The heat recovery steam generator system of claim 10, wherein the output line is parallel to the first collection line and the second collection line, the output line has an output line length, the first collection line has a first collection line length, the second collection line has a second collection line length, and the output line length is less than then first collection line length and less than the second collection line length.

16. The heat recovery steam generator system of claim 10, wherein the plurality of header lines include sequential sets of connecting lines, alternating sets of the sequential sets of connecting lines defined as odd alternating sets or even alternating sets, the odd alternating sets connecting to the first set of header links and the even alternating sets connecting to the second set of header links.

17. The heat recovery steam generator system of claim 10, wherein the output line has an output line diameter, the first collecting line has a first collecting line diameter, the second collecting line has a second collecting line diameter, and the output line diameter is at least twice the first collecting line diameter and at least twice the second collecting line diameter.

* * * * *